US006721526B2

(12) United States Patent
Shigeta et al.

(10) Patent No.: US 6,721,526 B2
(45) Date of Patent: Apr. 13, 2004

(54) IMAGE FORMING APPARATUS WITH IMPROVED DEVELOPING DEVICE

(75) Inventors: Kunio Shigeta, Hachioji (JP); Hiroshi Akita, Hachioji (JP); Takenobu Kimura, Hachioji (JP); Yotaro Sato, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/255,848

(22) Filed: Sep. 26, 2002

(65) Prior Publication Data

US 2003/0091372 A1 May 15, 2003

(30) Foreign Application Priority Data

Sep. 28, 2001 (JP) ..... 2001-302856

(51) Int. Cl.[7] ..... G03G 15/09
(52) U.S. Cl. ..... 399/267; 399/274; 399/277
(58) Field of Search ..... 399/267, 274, 399/277

(56) References Cited

U.S. PATENT DOCUMENTS 5,430,528 A * 7/1995 Kumasaka et al. ..... 399/267
5,532,803 A * 7/1996 Yasuda et al. ..... 399/274 X
5,860,049 A * 1/1999 Kumasaka et al. ..... 399/267

* cited by examiner

*Primary Examiner*—William J. Royer
(74) *Attorney, Agent, or Firm*—Muserlian, Lucas & Mercanti

(57) ABSTRACT

An image forming apparatus is provided for obtaining excellent developing properties using toner with small particle diameters and for forming high-quality visual images. In a developing device of an image forming apparatus, a two-component developer is used which satisfies conditions that volume mean particle diameter dt of a toner is 3~5 $\mu$m (Condition 1), volume mean particle diameter dc of a carrier is 5 dt~10 dt (Condition 2), and a weight ratio Rw of the toner and the carrier is 1.6 (dt/dc) ×(ρt/ρc)~2.4 (dt/dc)×(ρt/ρc) (Condition 3, where ρt and ρc are density of the toner and the carrier, respectively). A main magnetic pole M of a rotary sleeve is arranged in the vicinity of the closest position of the rotary sleeve and an image forming body, and the closest distance D between the rotary sleeve and the image forming body satisfies a condition that D is 0.5 H~0.8 H for the free tip height H of a magnetic brush B of the main magnetic pole M. It is preferable that the actual supplied amount of the toner is regulated within a specific range.

13 Claims, 3 Drawing Sheets

IMAGE FORMING APPARATUS WITH IMPROVED DEVELOPING DEVICE

BACKGROUND OF THE INVENTION

1. Field of the Invention

The present invention relates to an image forming apparatus capable of forming clear, high-quality visual images.

2. Description of the Related Arts

In recent years, in image formation using electrophotography, a technique in which particles with small diameters are used has been proposed to form visual images with the high quality equal to that of offset printing.

For example, according to Japanese Patent Application Laid-open (kokai) No. 2000-81722, it is described that;

by using a toner comprising coloring particles including at least bonding resin and coloring agent, (1) the volume mean particle diameter of the coloring particle is 2.0~5.0 μm, the coloring particles with diameters of 1.0 μm or less are 20% of toner particles in number or less and the coloring particles with diameters exceeding 5.0 μm are 10% of the toner particles in number and, (2) the coloring agent is pigment particle, a full-color image can be obtained that is as high-quality as, or more high-quality than an image obtained by offset printing, has a very high performance in reproducibility of thin lines and the gray-scale and does not give any strange visual feeling. In addition, it is also described in the same reference that, in the full-color image forming method in which a full-color image is formed by overlaying on a transfer material toner images of each of at least four (4) colors of cyan, magenta, yellow and black, the reproducibility of thin lines and disorder of the image on the transfer material are improved, thickness of the image is reduced and a very high-quality image can be formed by employing toners satisfying the above requirements as the toners of the four colors used.

In Japanese Patent Application Laid-open (kokai) No. 2000-98657, the requirements for a carrier such as particle diameters, resistance that may be combined with the above toners are disclosed.

However, toners with small particle diameters will have stronger van der Waals force as the particle diameter becomes smaller, so that such toners will have a stronger force for adhering to carrier particles in comparison with the conventional toners. Therefore, when images are tried to be developed with the toners of small particle diameters by the conventionally known two-component magnetic brush method that is described in the above Japanese Patent Application Laid-open (kokai) Nos. 2000-81722 and 2000-305361, a satisfactory developing performance can not be obtained. Resulting visual images will suffer from, for example, decrease in image density and thinning of horizontal lines. When, for example, the linear velocity of the developing roller is increased extremely to secure the developing property, such phenomena as adhesion of the carrier to an image forming body comprising a photosensitive body (beads carry over) and scattering around of the carrier (carrier scattering) will occur.

Because of the reasons described above, it is necessary in practice to take some measures for improving the developing property when the toners with small particle diameters are used.

As a result of extensive discussions of formation of visual images using the toners with small particle diameters based on the situation described above, aiming at the improvement of the developing property, the inventors found that, in the conventional developing method utilizing an electric field, i.e., a method in which development is conducted by liberation of the toner particles electrostatically from the carrier by mainly the force of an electric field formed between the rotary sleeve for delivering the developer and the photosensitive body, it is difficult to liberate the toner particles from the carrier effectively when the toners with small particle diameters having large van der Waals force acting as the non-electrostatic adhering force are used, but the developing property can be improved because the toners with small particle diameters can be liberated from the carrier effectively when the two-component developer is strongly agitated under specific conditions.

In order to allow the developer to be agitated strongly, the approach of increasing the linear velocity of the rotary sleeve is commonly effective. However, in this approach, carrier adhesion and carrier scattering occur as a result of increased centrifugal force at the rotary sleeve and, thus, it is not an advantageous approach.

In addition, in order to have the stronger agitation of the developer, it has been found that lowering the height of the tip of the magnetic brush by reducing the amount of the developer on the rotary sleeve for preventing the developer from being packed in the developing area is effective in practice. That is, according to this approach, the agitation of the developer in the developing area can be made stronger by developing on magnetic poles with the two-component developer on the rotary sleeve while keeping the magnetic brush slightly in contact with the photosensitive body with the result that the toner with small particle diameters becomes easy to be liberated from the carrier and the developing efficiency is consequently improved.

SUMMARY OF THE INVENTION

The present invention has been made in view of the above findings. It is therefore the object of the present invention to provide an image forming apparatus which ensures acquisition of excellent developing properties using toner with small particle diameters and, thus, can form high-quality visual images.

According to a first aspect of the present invention there is provided an image forming apparatus which comprises an image forming body, and a developing device for developing a latent image formed on the image forming body with a two-component developer consisting of a toner and a carrier, the developing device including a rotary sleeve positioned facing the image forming body, for delivering the two-component developer and, a magnet system positioned inside the rotary sleeve, for forming a plurality of magnetic poles to form a magnetic brush made of the two-component developer on the surface of the rotary sleeve, and a developer layer regulating member positioned facing the surface of the rotary sleeve, for regulating the amount of the two-component developer delivered by the rotary sleeve, wherein where dt (μm) represents the volume mean particle diameter of the toner in the two-component developer, ρt ($g/cm^3$) represents the density of the toner, dc (μm) represents the volume mean particle diameter of the carrier, ρc ($g/cm^3$) represents the density of the carrier, and Rw represents the weight ratio of the toner and the carrier (the ratio of the weight of the toner to the weight of the carrier), Conditions 1, 2 and 3 are satisfied, Condition 1: the volume mean particle diameter dt of the toner is within the range of 3~5 μm, Condition 2: the volume mean particle diameter dc falls within the range of 5 dt~10 dt, and Condition 3: the weight ratio Rw of the toner and the carrier is within the range of 1.6 (dt/dc)×(ρt/ρc)~2.4 (dt/dc)×(ρt/ρc), and wherein among a plurality of the magnetic poles included in the magnet system, a main magnetic pole, forming the strongest magnetic field on the surface of the rotary sleeve, is positioned in proximity to the position where the rotary sleeve and the image forming body come closest to each other, and wherein where H (mm) represents the free tip height of the magnetic brush formed at the position of the main magnetic pole, and D (mm) represents the closest distance between the rotary sleeve and the image forming body, Condition 4 is satisfied, Condition 4: the closest distance D is within the range of 0.5 H~0.8 H.

In the above-described image forming apparatus, it is preferable that the following Condition 3A is satisfied for the weight ratio Rw of the toner and the carrier in the two-component developer;

Condition 3A: the weight ratio Rw of the toner and the carrier is within the range of 1.8 (dt/dc)×(ρt/ρc)~2.2 (dt/dc)×(ρt/ρc).

According to a second aspect of the present invention there is provided an image forming apparatus which comprises an image forming body, and a developing device for developing a latent image formed on the image forming body with a two-component developer consisting of a toner and a carrier, the developing device including a rotary sleeve positioned facing the image forming body, for delivering the two-component developer and, a magnet system positioned inside the rotary sleeve, for forming a plurality of magnetic poles to form a magnetic brush made of the two-component developer on the surface of the rotary sleeve, and a developer layer regulating member positioned facing the surface of the rotary sleeve, for regulating the amount of the two-component developer delivered by the rotary sleeve, wherein where dt (μm) represents the volume mean particle diameter of the toner in the two-component developer, W ($mg/cm^2$) represents the delivered amount per unit area of the two-component developer delivered by the rotary sleeve, Tc (weight percent) represents the toner concentration in the two-component developer, and Rv represents the ratio of the moving velocity of the rotary sleeve to the moving velocity of the image forming body, conditions;

Condition 1: the volume mean particle diameter dt of the toner falls within the range of 3~5 μm, Condition 5: the delivered amount W of the two-component developer falls within the range of 10~50 $mg/cm^2$, and Condition 6: the actual supplied amount of the toner represented by an expression, (W×Tc×Rv)/100 falls within the range of 2~10 $mg/cm^2$, are satisfied;

and wherein among a plurality of magnetic poles included in the magnet system, a main magnetic pole forming the strongest magnetic field on the surface of the rotary sleeve is positioned in proximity to the position where the rotary sleeve and the image forming body come closest to each other, and wherein where H (mm) represents the free tip height of the magnetic brush formed at the position of the main magnetic pole, and D (mm) represents the closest distance between the rotary sleeve and the image forming body, a condition, Condition 4: the closest distance D falls within the range of 0.5 H~0.8 H is satisfied.

In the above-described image forming apparatus of the invention, it is preferable that, where dt (μm) represents the volume mean particle diameter of the toner in the two-component developer, ρt ($g/cm^3$) represents the density of the toner, dc (μm) represents the volume mean particle diameter of the carrier, ρc ($g/cm^3$) represents the density of the carrier, and Rw represents the weight ratio of the toner and the carrier (the ratio of the weight of the toner to the weight of the carrier), conditions;

Condition 2: the volume mean particle diameter dc of the carrier is within the range of 5 dt–10 dt, and Condition 3 is safisfied, Condition 3: the weight ratio Rw of the toner and the carrier falls within the range of 1.6 (dt/dc)×(ρt/ρc)~2.4 (dt/dc)×(ρt/ρc).

Furthermore, it is preferable that the following Condition 6A is satisfied,

Condition 6A: the actual supplied amount of the toner represented by an expression, (W×Tc×Rv)/100 falls within the range of 4~8 $mg/cm^2$.

In the above image forming apparatus, it is preferable that, in the developing device, a bias voltage consisting of a DC voltage superimposed with a AC voltage is applied to the rotary sleeve.

Furthermore, it is preferable that, in the developing area where the rotary sleeve faces the image forming body and the image forming device move in the same direction and that the main magnetic pole is the first magnetic pole downstream in the direction of movement of the rotary sleeve from the developer layer regulating member.

Additionally, in the developing device, the main magnetic pole is positioned upstream in the direction of movement of the rotary sleeve from the position where the rotary sleeve and the image forming body comes closest to each other.

The image forming apparatus of the present invention comprises a plurality of image forming bodies, each forming toner images of colors of yellow, magenta, cyan and black, respectively, and an intermediate transferring body on which each of the toner images formed on the plurality of image forming bodies is transferred and superimposed one after another and, constitutes an image forming apparatus forming colored images.

According to the above-mentioned image forming apparatus, development on the magnetic poles is conducted with the main magnetic pole formed by providing the magnetic poles in a specific arrangement using the two-component developer comprising the toner with small particle diameters satisfying Condition 1 and the carrier with small particle diameters satisfying Condition 2 contained at a ratio satisfying Condition 3, and a latent image on a photosensitive material drum is developed in the situation of a slight contact in which only the tip end of the magnetic brush B is in contact with the photosensitive material drum since the height of the free tip of the magnetic brush is in a specific situation satisfying Condition 4. Therefore, a visual image having a high image quality equal to or better than that of, for example, offset printing can be easily formed.

Furthermore, since the actual delivered amount of the toner delivered actually to the developing area P is secured by satisfying Condition 5 and Condition 6, the lowering of the image density is reliably prevented and, therefore, a high-quality visual image can be reliably formed.

BRIEF DESCRIPTION OF THE DRAWINGS

The above and other objects, aspects, features and advantages of the present invention will become more apparent from the following detailed description when taken in conjunction with the accompanying drawings, in which.

DESCRIPTION OF THE PREFERRED EMBODIMENTS

The present invention will now be described with reference to the accompanying drawings.

Figure 1:
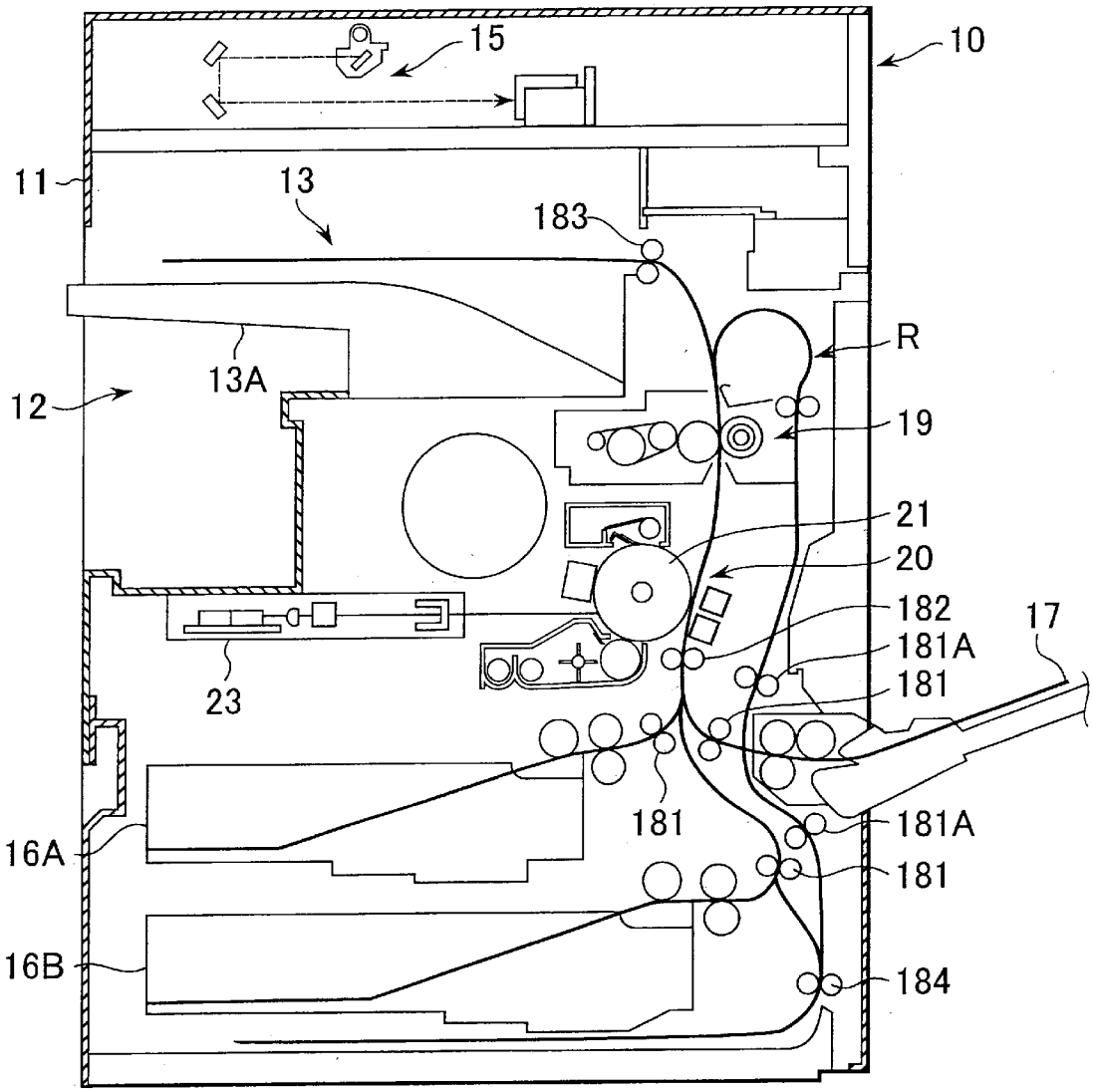
FIG. 1 illustrates a schematic view of the structure in an example of an image forming apparatus of the invention.
Figure 2:
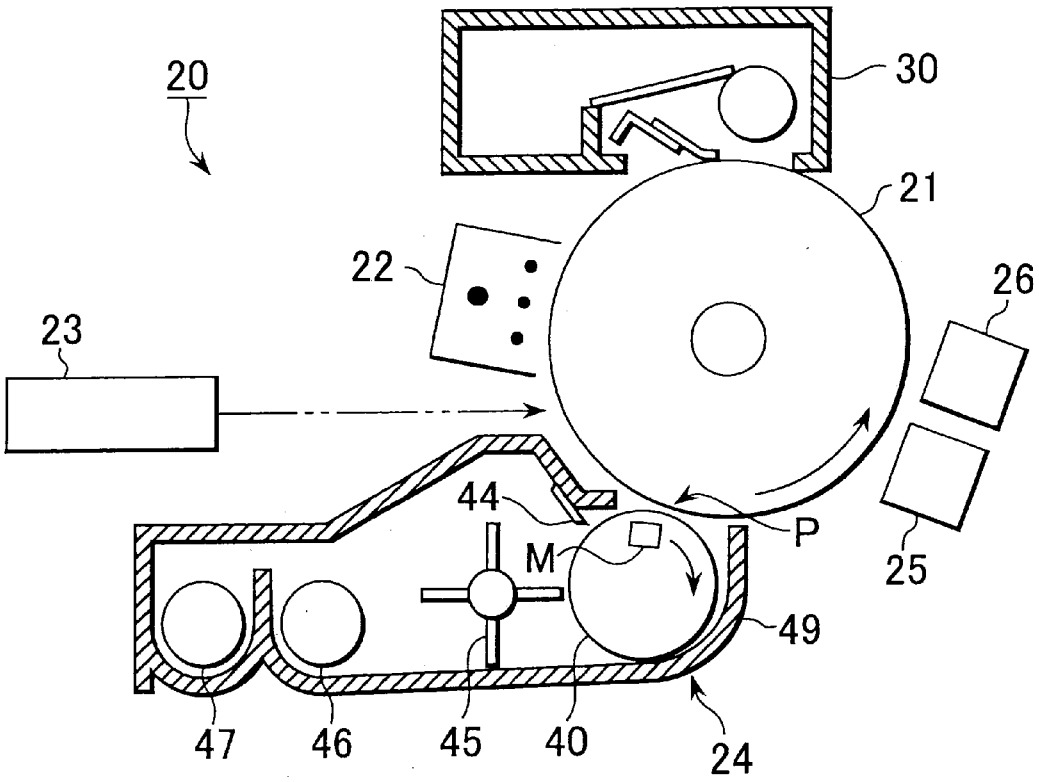
FIG. 2 illustrates a schematic view of the structure of an image forming unit of the image forming apparatus shown in FIG. 1.

FIG. 1 is an illustrative schematic view showing the structure with an example of an image forming apparatus of the invention. FIG. 2 is an enlarged illustrative cross-sectional view of an example of the structure of a developing device of the image forming apparatus.

An image forming apparatus 10 is of so-called in-drum-discharge-type. Describing more specifically, a sheet discharge section 13 is provided in a portion 12 that opens toward the front side with respect to this page and one lateral side (on the left hand side of the figure) of an external housing 11 and a sheet containing mechanism 13A including a tray is provided in the sheet discharge section 13.

Inside the external housing 11, an original image reading mechanism 15 for reading an original image to obtain image information by optically scanning an original is arranged in an upper section of the apparatus 10, an image forming unit 20 for forming a visual image based on the image information from the original image reading mechanism 15 is arranged in an intermediate section of the apparatus 10 and sheet supply units 16A and 16B in which sheets of, for example, transferring paper as an image recording material are contained is arranged in a lower section of the apparatus 10.

A manual sheet supply unit 17 is also arranged on another lateral side (on the right hand side of the drawing) of the image forming apparatus 10. In FIG. 1, R denotes a reverse feeding mechanism for delivering again a sheet on which a visual image has been formed on one side thereof to the image forming unit 20 when visual images are formed on both sides of the sheet.

In the image forming apparatus 10, with an order signal issued by a series of ordering operations conducted at an operation section such as selection and designation of conditions including number of copies to be made, ratio of enlargement or reduction and size of a recording material, reading of the original image are conducted by optically scanning the original with the original image reading mechanism 15 and a toner image is formed on a photosensitive body drum 21 as an image forming body by the image forming unit 20 based on image data from the original image reading mechanism 15. On the other hand, a sheet selected from the sheet supply units 16A and 16B or the manual sheet supply unit 17 is fed along a feeding path by a guide roller 181 and the sheet is fed to the image forming unit 20 by a resist roller 182 that corrects an inclination and a dislocation in synchronization with the toner image formed on the photosensitive body drum 21 in the image forming unit 20.

Then, after the toner image formed by the image forming unit 20 has been transferred to the sheet fed and has been applied with a fixing process in a fixing device 19, the sheet is discharged onto the sheet containing mechanism 13A by a discharging roller 183 with the sheet carrying the visual image formed thereon facing beneath.

In case that visual images are to be formed on both sides of a sheet, the sheet discharged from the fixing device 19 is fed along a reverse feeding path by a guide roller 181A and is again fed to the image forming unit 20 by a reverse roller 184 with the other side of the sheet having a visual image formed on its one side facing the photosensitive body drum 21 in the image forming unit 20. Then, another visual image is formed on the other side of the sheet.

As shown in FIG. 2, the image forming unit 20 comprises a photosensitive body drum 21 that is driven rotating counterclockwise, and charging means 22, exposing device 23, developing device 24, transferring means 25, separation means 26 and cleaning device 30 arranged in order of operation in the direction of rotation of the photosensitive body drum 21 along the outer circumference of the photosensitive body drum 21.

The photosensitive body drum 21 has an adequate photosensitive layer formed on the outer circumference surface of, for example, a drum-shaped metal base and the photosensitive layer includes but is not limited to, for example, inorganic photosensitive layers comprising selenium, selenium arsenide, amorphous selenium (a-Se), cadmium sulfide (CdS), zinc oxide ($ZnO_2$) and amorphous silicon (a-Si) and organic photosensitive layers made of organic photoconductive compounds. A preferable photosensitive body drum 21 is the one comprising a photosensitive layer made of resin containing an organic photoconductor. A particularly preferable photosensitive body drum 21 is of function-separated-type that is formed with a charge carrying layer and a charge generating layer stacked together.

The exposing means 23 comprises a digital optical system for converting digitized image data into an optical signal and exposing the photosensitive body drum 21, such as, for example, a laser emitting device constituting a laser optical system and, with the exposing means 23, a laser beam from a light source (not shown) comprising, for example, a laser diode is emitted selectively to a surface of the photosensitive body drum 21 through an optical system including a rotating polygon mirror, a fθ lens and a cylindrical lens.

As shown in FIG. 2, in a housing 49 in which a two-component developer comprising a toner and a carrier is housed, the developing device 24 comprises a rotary sleeve 40 for carrying on and delivering the two-component developer to the outer circumference surface thereof and a developer layer regulating member 44 for regulating the thickness of the layer of the developer on the rotary sleeve 40.

The reference number 45 denotes a paddle-type developer delivering and supplying member for delivering and supplying the developer to the rotary sleeve 40 while agitating the developer and the reference numbers 46 and 47 denote helical rotary screws that function as developer agitating members for mixing and agitating the two-component developer in the housing 49.

The rotary sleeve 40 is made of, for example, aluminum and its surface faces the outer surface of the photosensitive body drum 21 through a small gap at an opening for development of the housing 49 and is adapted to be rotated clockwise as shown by the arrow to move with the photosensitive body drum 21 in the same direction in a developing area P constituted by the gap.

Inside the rotary sleeve 40, a plurality of fixed magnets are arranged to constitute the magnet system for forming a magnetic brush constituted by the two-component developer on the surface of the rotary sleeve 40.

In this magnetic system, the first magnet downstream in the direction of rotation of the rotary sleeve 40 from the developer layer regulating member 44 is defined as a main magnetic pole M for developing. This main magnetic pole M is arranged at a position in the proximity of the position where the rotary sleeve 40 and the photosensitive body drum 21 approach most closely, for example, a position slightly upstream of the photosensitive body drum 21 in its rotating direction.

Figure 3:
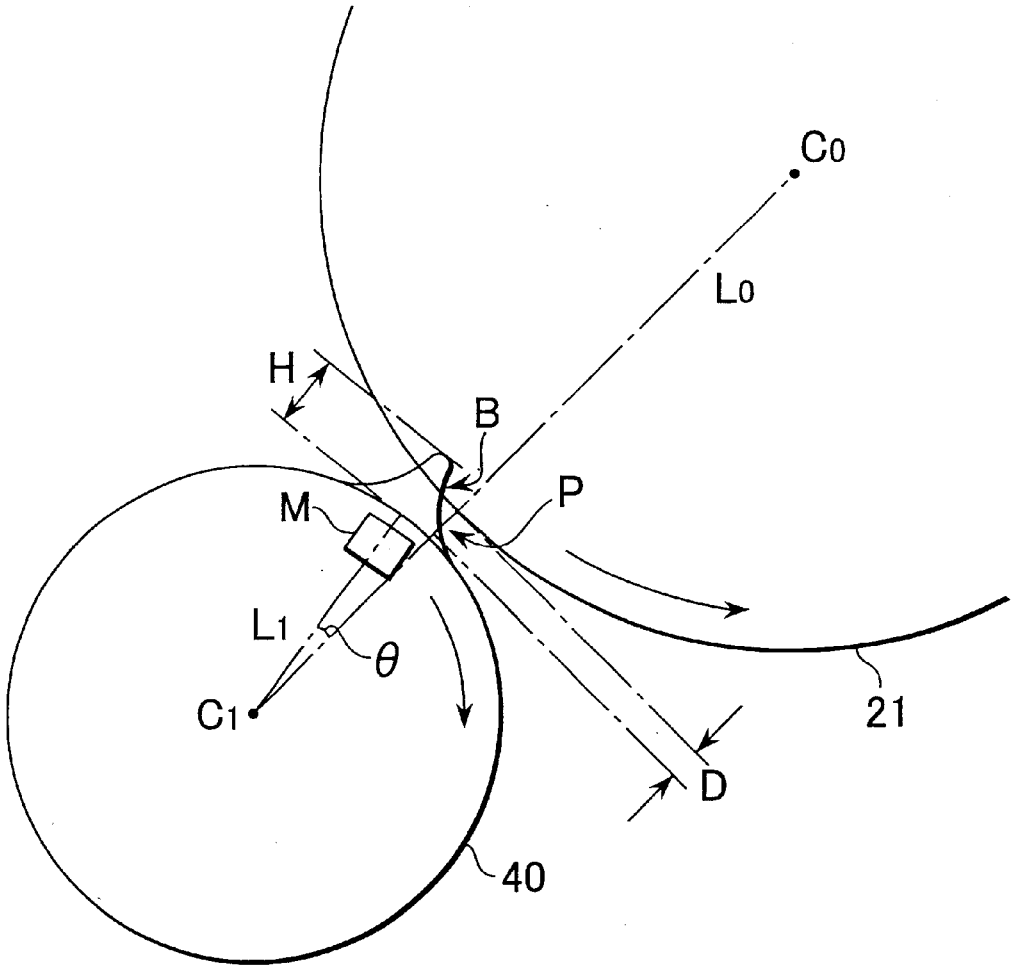
FIG. 3 illustrates a developing device of the image forming apparatus shown in FIG. 2.

More specifically, as shown in FIG. 3, the position of the main magnetic pole M is displaced to the upstream side in the direction of rotation of the photosensitive body drum 21 from the line $L_0$ spanning from the center $C_1$ of the rotary sleeve 40 to the center $C_0$ of the photosensitive body drum 21. That is, as shown in FIG. 3, in the developing area P, the position of the main magnetic pole M is displaced to the upstream side in the direction of the rotation of the rotary sleeve 40 when the rotary sleeve 40 and photosensitive body drum 21 move in the same direction and is displaced to the downstream side in the direction of the rotation of the rotary sleeve 40 when the rotary sleeve 40 and photosensitive body drum 21 move in opposite directions against each other. However, regardless of the direction of the rotation of the rotary sleeve 40, it is preferable that the displacement angle θ that the line $L_1$ spanning from the center of the rotary sleeve, 40 to the main magnetic pole M makes against the line $L_0$ (the line spanning from the center of the rotary sleeve 40 and the center of the photosensitive body drum 21) on which the closest position of the rotary sleeve 40 and photosensitive body drum 21 is located is 5° or less.

With the structure described above, the position of the highest point of a magnetic brush B formed by the main magnetic pole M on the rotary sleeve 40 is positioned slightly upstream in the direction of rotation of the photosensitive body drum 21 from the position where the photosensitive body drum 21 approaches most closely to the rotary sleeve 40 and an electrostatic latent image on the photosensitive body drum 21 is developed to form a toner image by being contacted by the magnetic brush B with the surface of the photosensitive body drum 21 under a specific condition in the developing area P in the gap between the rotary sleeve 40 and the photosensitive body drum 21.

At the position where the main magnetic pole M is arranged, where a free tip height (the maximum height of the tip of the magnetic brush B formed freely without contacting the photosensitive body drum 21) of the magnetic brush B formed on the surface of the rotary sleeve 40 is represented by H (mm) and a separation distance at the closest position between the rotary sleeve 40 and photosensitive body drum 21 (the closest distance) is represented by D (mm), the following Condition 4 is required to be satisfied.

Condition 4

The closest distance D is within the range of 0.5 H~0.8 H.

Condition 4 can be realized by setting adequately the conditions of each component of the developing device 24 such as, for example, the magnetic intensity of the main magnetic pole M, rotation velocity of the rotary sleeve 40, the characteristics of the two-component developer together with the toner and other conditions.

Condition 4 is satisfied if the value of the free tip height H is 1.25~2 times larger than the most closest distance D in the developing area P.

In the image forming apparatus 10 of the invention, a two-component developer comprising a toner and a carrier satisfying the following Conditions 1~3 is used as the developer.

Condition 1

The volume mean particle diameter dt falls within the range of 3~5 μm.

A clear and highly reproducible visual image can be basically obtained by the toner with small particle diameter satisfying Condition 1. In other words, the image quality of half-tone portion can be improved and the image quality of fine lines and dots can be improved.

Condition 2

The volume mean particle diameter dc of the carrier falls within the range of 5 dt~10 dt.

A carrier satisfying Condition 2 has small particle diameters of 5~10 times larger than the volume mean particle diameter of the toner and, since the volume mean particle diameter of the toner is 3~5 μm as described above, the carrier has a volume mean particle diameter of 15~50 μm.

Since the entire surface area becomes larger by using carriers with these specific small particle diameters, the absolute amount of the toner actually supplied to the developing area P by the rotary sleeve 40, i.e., the actual supplied amount is increased. In addition, since the free tip height H of the magnetic brush B formed becomes lower because the extent of the magnetization of the carrier becomes smaller, a situation that satisfies Condition 4 relating to the free tip height H of the magnetic brush B can be easily realized.

Condition 3

The ratio of weight of the toner to that of the carrier Rw falls within the range of 1.6 (dt/dc)×(ρt/ρc)~2.4 (dt/dc)×(ρt/ρc).

In the expression of Condition 3, ρt and ρc represent respectively the density (unit: g/cm3) of the toner and the carrier.

It is preferable that Rw falls within the range of 1.8 (dt/dc)×(ρt/ρc)~2.2 (dt/dc)×(ρt/ρc) when the rotary sleeve 40 and the photosensitive body drum 21 moves in the same direction (Condition 3A) while Rw falls within the range of 1.6 (dt/dc)×(ρt/ρc)~2.0 (dt/dc)×(ρt/ρc) when they move in opposite directions against each other (Condition 3B).

Condition 3 defines the ratio of the entire surface area of the toner against the entire surface area of the carrier in the two-component developer and this ratio is a factor relating to the coverage by the toner over the carrier surface.

Satisfying Condition 3 means that the coverage by the toner over the carrier (hereinafter referred to as "toner coverage") becomes substantially 45~65%, satisfying the Condition 3A means that the toner coverage becomes substantially 50~60% and satisfying Condition 3B means that the toner coverage becomes substantially 45~55%.

In case that Rw is too small and the toner coverage is too small, the actual supplied amount of the toner to the developing area P runs short, the image density of the visual image formed becomes insufficient and thinning of horizontal lines occurs in the image. On the other hand, in case that Rw is too large and the toner coverage is too large, the charging of the toner becomes insufficient and fog may appear in the visual image formed.

With the structure described above, it is preferable that the closest distance D between the rotary sleeve 40 and the photosensitive body drum 21 is 0.2~0.6 mm and, specifically, 0.24~0.5 mm.

In addition, it is preferable that the free tip height H of the magnetic brush B formed by the main magnetic pole M on the rotary sleeve 40 is 0.25~1.2 mm, specifically 0.3~1.0 mm.

In the developing device 24, the following conditions are satisfied.

Condition 5

The delivered amount of the two-component developer W per unit area supplied by the rotary sleeve 40 is within the range of 10~50 mg/cm$^2$.

Taking into consideration the fact that this value for the conventional image forming apparatus falls within the range of around 80~100 mg/cm$_2$, satisfying Condition 5 means that the delivered amount of the developer is regulated to a small amount.

By satisfying Condition 5, the free tip height H of the magnetic brush B that is formed by the main magnetic pole M on the surface of the rotary sleeve 40 basically becomes small and, therefore, it is easy to realize a situation of "being slightly contacted" in which the magnetic brush B contacts the photosensitive body drum 21 at the top of the tip without increasing the closest distance D.

In an actual developing apparatus, it is preferable that the separation distance between the developer layer regulating member 44 and the rotary sleeve 40 falls within the range of 0.2~0.6 mm.

In addition to the above, the development is conducted satisfying the following Condition 6.

Condition 6

The actual supplied amount of the toner represented by an expression, (W×Tc×Rv)/100 falls within the range of 2~10 mg/cm$^2$.

Specifically, it is preferable that the following Condition 6A is satisfied when the rotary sleeve 40 and the photosensitive body drum 21 move in the same direction and the following Condition 6B is satisfied when they move in opposite directions against each other.

Condition 6A

The actual supplied amount of the toner represented by an expression, (W×Tc×Rv)/100 falls within the range of 4~8 mg/cm$^2$.

Condition 6B

The actual supplied amount of the toner represented by an expression, (W×Tc×Rv)/100 falls within the range of 2~6 mg/cm$^2$.

In Conditions 6, 6A or 6B, Tc represents the toner concentration (weight percent) of the two-component developer and Rv represents the ratio (Vs/Vp) of the linear velocity Vs of the rotary sleeve 40 to the linear velocity Vp of the photosensitive body drum 21.

Within the range of the actual supplied amount of the toner when Condition 6 is satisfied, if the maximal amount of the toner adhered onto the photosensitive body drum 21 is, for example, 0.2 mg/cm$^2$, 0.3 mg/cm$^2$, 0.4 mg/cm$^2$ and 0.5 mg/cm$^2$, the developing efficiency will be respectively 2~10%, 3~15%, 4~20% and 5~25%.

In this way, Condition 6 is satisfied when the actual supplied amount of the toner of the two-component developer delivered to the developing area P is regulated and, therefore, the visual image thus obtained is prevented from accompanying the negative effects such as low image density.

The operation of the image forming device of the above structure is as follows.

An original image is read by the original image reading mechanism 15 and image information is obtained. A latent image is formed on the surface of the photosensitive body drum 21 by exposing by the exposing device 23 based on image information. Then, at the same time, a transfer sheet as a recording material is fed from the sheet supply units 16A, 16B or the manual sheet supply unit 17 and is forwarded to the transferring means 25 in synchronization with the photosensitive body drum 21.

In the developing device 24, the toner and the carrier are agitated and mixed by the rotary screws 46 and 47 in the housing 49 and the developer further forwarded by the developer delivering and supplying member 45 adheres on the surface of the rotary sleeve 40 to form a developer layer. The developer layer is regulated to a predetermined amount by regulating its thickness with the developer layer regulating member 44. This developer layer is forwarded to the developing area P by the rotation of the rotary sleeve 40.

Then, in the developing area P, the developer layer forms the magnetic brush B on the surface of the photosensitive body drum 21 by the action of the main magnetic pole M and contacts the surface to form an electromagnetic latent image. Then, a toner image is obtained by development with the toner onto the latent image.

The toner image formed in this way on the surface of the photosensitive body drum 21 is transferred by the transferring means 25 onto a recording material comprising, for example, paper. Then, the recording material closely stuck to the photosensitive body drum 21 is separated therefrom by the separation means 26 after the toner image has been transferred.

The paper separated from the photosensitive body drum 21 is forwarded to the fixing device 19 where the toner image is fixed with heat, a visual image corresponding to the original image is formed on the paper and the visual image thus formed is forwarded and discharged out of the apparatus 10.

The toner remaining on the surface of the photosensitive body drum 21 after the paper has been separated is removed while passing through the cleaning device 30.

The two-component developer used in the image forming apparatus 10 of the invention comprises non-magnetic toner and magnetic carrier.

As the non-magnetic toner, for example, a toner comprising colored particles containing bonding resin and coloring agent is used and it is preferable that the toner particles are added and mixed with inorganic powder.

The bonding resin for the non-magnetic toner is not specifically limited but known resins such as styrene resins, acrylic resins, acrylate-styrene copolymer resins and polyester resins may be used.

As the coloring agent used for the non-magnetic toner, for example, carbon black, Nigrosine dye may be used for black toner and, as the pigments necessary for yellow, magenta and cyan toners, C. I. pigment blue 15:3, C. I. pigment blue 15, C. I. pigment blue 15:6, C. I. pigment blue 68, C. I. pigment red 48-3, C. I. pigment red 122, C. I. Pigment red 57-1, C. I. pigment yellow 17, C. I. pigment yellow 81, C. I. pigment yellow 154 may be preferably used.

If required, the non-magnetic toner may contain a release agent, a charge controlling agent, a fluidizing agent, a lubricant, a cleaning support agent and other additives and known materials may be used as the constituting material.

As a manufacturing method of the non-magnetic toner, a polymerization method may be used in which the toner can be obtained utilizing emulsion polymerization or suspension polymerization. With this manufacturing method, toners with sharp physical properties such as particle diameter distribution and electrostatic charge distribution or toner particles with a small diameter and sphere-shape can be easily obtained.

In addition, in this method, inorganic fine powder may be added and mixed with as an external additive.

Conventionally known materials such as metal, for example, iron, ferrite, magnetite, alloys of those metals with metals such as aluminum and lead may be used as the carrier. Ferrite particles are specifically preferable.

As the preferable carriers, resin-covered carrier in which the surface of the magnetic particles is covered with resin and so-called resin-dispersed carrier in which magnetic particles are dispersed in resin may be listed.

The resins for constituting the resin-covered carrier are not specifically limited but, for example, olefin resins, styrene resins, styrene/acrylic resins, silicon resins, polyester resins and fluoropolymer resins may be listed.

The resins for constituting the resin-dispersed carrier are not specifically limited but known resins, for example, styrene-acrylic resins, polyester resins, fluorocarbon resins and phenolic resins may be used.

The two-component developer is prepared by mixing the above-described non-magnetic toners and the magnetic carriers. The conventional mixer may be used for mixing the non-magnetic toner and the magnetic carrier but it is preferable to use a spinning-type mixer such as a V-type mixer, a W-coned mixer and a rocking mixer rather than a mixer in which the stress applied to the non-magnetic toner and the magnetic carrier is small such as, for example, a high-speed agitator including a Henshell mixer.

A bias voltage comprising, for example, a DC voltage superimposed with a AC voltage is preferably applied to the rotary sleeve 40. Since the efficiency of the liberation of toner particles from carrier particles in the developing area P is improved with the above bias voltage, the uniformity of the image density of the so-called black colored area can be secured, so that a high-quality visual image can be formed.

According to the image forming apparatus of the invention, using a two-component developer containing a toner with small particle diameters satisfying Condition 1 and a carrier with small particle diameters satisfying Condition 2 at a ratio satisfying Condition 3, development on magnetic poles including the main magnetic pole M provided in the specific arrangement is performed. At the same time, since a latent image on a photosensitive body drum 21 is developed in such situation of a slight contact that only the tip end of the magnetic brush B contacts the photosensitive body drum 21 with the free tip height H of the magnetic brush B satisfying Condition 4, a basically clear and fine visual image of high quality that is equivalent for example to an offset printing image can be easily formed.

Furthermore, the actual supplied amount of the toner actually delivered to the developing area P is secured by satisfying Condition 5 and Condition 6. Thus, in the development conducted in the above conditions, lowering of the image density can be reliably prevented and, therefore, a high-quality visual image can be reliably formed.

In the development on the magnetic pole by the slight contact as described above, there may be such conditions as to cause beads carry over comparing to a conventional case where the development on a magnetic pole is conducted in such situation that the magnetic brush B is compressed. However, in the invention, by satisfying the following conditions, the beads carry over can be actually reduced and can not cause any adverse effect on the visual image.

Condition:

The main magnetic pole M is positioned upstream in the direction of the rotation of the photosensitive body drum 21 from the proximity of the most closest position of the photosensitive body drum 21 and the rotary sleeve 40.

Since an adequate condition of the magnetic force lines is formed by satisfying this condition, such phenomenon that the magnetic brush B immediately rises at the position where the photosensitive body drum 21 is separated from the rotary sleeve 40, so that the carrier adheres to the photosensitive body drum 21 can be prevented and a phenomenon so-called "letter-scattering" can also be prevented from occurrence.

(A) The photosensitive body drum 21 and the rotary sleeve 40 move in the same direction in the developing area.

By satisfying this condition, the magnetic brush B is prevented from receiving excessive abrasion and, therefore, the phenomenon that the carrier adheres to the photosensitive body drum 21 can be prevented and, as a result, the phenomenon so-called "letter-scattering" is prevented from occurring.

(B) The first magnetic pole from the developer layer regulating member 44 along the rotation direction of the rotary sleeve 40 is the main magnetic pole M.

By satisfying this condition, the developer layer uniformed by the developer layer regulating member 44 is forwarded to the developing area P as it is. Thus, beads carry over can be prevented.

(C) The main magnetic pole M is positioned upstream in the direction of the rotation of the photosensitive body drum 21 from the proximity of the most closest position of the photosensitive body drum 21 and the rotary sleeve 40.

Since adequate magnetic force lines are formed by the main magnetic pole M on the surface of the rotary sleeve 40, development with a slight contact on the magnetic pole can be reliably conducted.

The image forming apparatus 10 of the invention can be preferably realized as a color image forming apparatus employing the intermediate transfer body scheme. In this color image forming apparatus, for example four image forming units each having a photosensitive body drum and an intermediate transfer body comprising, for example, an intermediate belt are provided and each of the toner images of each color of yellow, magenta, cyan and black is transferred onto the intermediate transfer body and is overlaid one after another. Thus, a full-color image can be formed.

Then, an extremely high-quality visual color image can be formed by satisfying all the above conditions.

DESCRIPTION OF EXAMPLES

Now, the examples of the invention will be described but the invention is not limited to these examples.

Example 1

An image forming apparatus equipped with a developing device having the structure shown in FIG. 2 was fabricated according to the structure shown in FIG. 1.

In this image forming apparatus 10, a photosensitive body drum 21 comprises an organic photosensitive body with a diameter of 60 mm, a developing device 24 comprises a rotary sleeve 40 of which the surface is roughened by applying stainless thermal spray to the outer circumference of a sleeve member made of aluminum with a diameter of 25 mm such that the surface roughness is 1.0 $\mu$m and, a magnet system made of ferrite forming a main magnetic pole M is provided inside a rotary sleeve 40.

In addition, a developer layer regulating member 44 made of aluminum is arranged to face the rotary sleeve 40.

The concrete specifications of each component and the conditions of a two-component developer are as follows.

The toner of the two-component developer was prepared in an emulsion polymerization method using styrene-acryl and has 4.0 $\mu$m of the volume mean particle diameter dt and 1.1 g/cm$^3$ of the density ρt (Condition 1).

The carrier was manufactured by covering the surface of magnetic particles made of ferrite with a silicon resin and has 30 $\mu$m of the volume mean particle diameter dc and 4.5 g/cm$^3$ of the density ρt. These values correspond to dc=7.5 dt (Condition 2).

The two-component developer was prepared by mixing the toner and the carrier at a ratio such that the toner concentration Tc was 6.0 mass percent and the value of the weight ratio Rw of the toner and the carrier in the two-component developer is 0.06 and the value was 2.0 (dt/dc)×(ρt/ρc) (Condition 3).

In the developing device, the rotation direction of the rotary sleeve 40 is same as that of the photosensitive body drum 21 and the displacement angle θ of the main magnetic pole M provided inside the rotary sleeve 40 is 5° on the upstream side (toward the rotary sleeve 40) in the rotation direction of the photosensitive body drum 21. The free tip height H of the magnetic brush B formed by the main magnetic pole M is 0.8 mm, the closest distance D between the rotary sleeve 40 and the photosensitive body drum 21 is 0.5 mm and the closest distance D corresponded to 0.63 H (Condition 4).

Under a condition that the linear velocity Vp of the photosensitive body drum 21 is 180 mm/sec, the linear velocity Vs of the rotary sleeve 40 is 540 mm/sec and the value of Rv (=Vs/Vp) is 3.0, the separation distance or closest distance D between the surface of the rotary sleeve 40 and the developer layer regulating member 44 is adjusted to be 0.4 mm. Thus, the delivered amount W of the two-component developer is adjusted to be 35 mg/cm$^3$ (Condition 5).

Then, the actual amount supplied of the toner represented by the expression (W×Tc×Rv)/100 is 6.8 mg/cm$^3$.

Furthermore, a developing bias voltage of a DC −600 V superimposed with an AC voltage having a peak-to-peak voltage of 1.5 kV and a frequency of 2 kHz is applied to the rotary sleeve 40.

Visual images were formed one million times continuously by operating the image forming apparatus of the above structure and image density, fog, line width, letter quality and beads carry over were evaluated in the following evaluation procedure. As a result, all of the visual images obtained were of very high image quality.

Image Density:

The transmission density of solid portion was measured by an image evaluation device ("ImageXpert" manufactured by ImageXpert Co., Inc.).

○. . . The transmission density was 1.4 or more.

×. . . The transmission density was less than 1.4.

Fog

The relative reflection density of the bare paper surface was measured by an image evaluation device ("ImageXpert" manufactured by ImageXpert Co., Inc.) assuming the relative reflection density of the paper as 0.000.

○. . . The relative reflection density was less than 0.004.

×. . . The relative reflection density was 0.004 or more.

Line Width:

The line width of a two-dot line having the writing density of 400 dpi was measured by an image evaluation device ("ImageXpert" manufactured by ImageXpert Co., Inc.).

○. . . The line width was 118 μm or more and 135 μm or less.

×. . . The line width was less than 118 μm or more than 135 μm.

Letter Quality:

Three-point alphabets ("KONICA") and six-point Chinese characters ("祇園精舎の鐘の声") were enlarged and observed by a digital microscope (KEYENCE Co., Inc.) and the sharpness of the edge portion (briskness), toner scattering around the edge portion (letter-scattering) were evaluated.

⊙. . . There was no letter-scattering and the sharpness at the edges and tips of letters (briskness) was excellent.

○. . . There was no letter-scattering and briskness was good.

×. . . There was remarkable letter-scattering and briskness was bad.

Beads Carry Over:

The carrier adhered to the bare surface adjacent to a two-dot horizontal line was visually observed and white dots in solid portion (a white dot was created by a point where a carrier particle dropped from the photosensitive body drum when the carrier had adhered on the photosensitive body drum) were visually observed.

○. . . Both of adhesion of carrier on the bare surface and white dots did not occur.

×. . . Either or both of adhesion of carrier on the bare surface and white dots occurred.

Examples and Comparative Examples

According to the conditions listed in Table 1 and Table 2, similar visual image forming tests were conducted varying the condition of each component of the image forming apparatus and their results were evaluated.

Table 1 and Table 2 are separated for the reason of space but they should be understood as one table.

TABLE 1

In Table 1, α in [Rw/α] among the items listed in the column for Condition 3 is (dt/dc) × (ρt/ρc), dt represents toner particle diameter (μm), dc represents carrier particle diameter (μm), ρt represents toner density (g/cm$^3$), ρc represents carrier density (g/cm$^3$), Rw represents toner/carrier weight ratio, D represents closest distance (mm), H represents free tip height (mm) and W represents developer supplied amount (mg/cm$^2$).

| | Condition 1 | Condition 2 | | Condition 3 | | | | Condition 4 | | | Condition 5 |
|---|---|---|---|---|---|---|---|---|---|---|---|
| Example | dt | dc | dc/dt | ρt | ρc | Rw | Rw/α(*1) | D | H | D/H | W |
| Example 1 | 4.0 | 30 | 7.5 | 1.1 | 4.5 | 0.06 | 2.0 | 0.5 | 0.8 | 0.63 | 35 |
| Example 2 | 4.0 | 30 | 7.5 | 1.1 | 4.5 | 0.06 | 2.0 | 0.5 | 0.7 | 0.71 | 30 |
| Example 3 | 4.0 | 30 | 7.5 | 1.1 | 4.5 | 0.06 | 2.0 | 0.5 | 1.0 | 0.50 | 50 |
| Comparative Example 1 | 4.0 | 30 | 7.5 | 1.1 | 4.5 | 0.06 | 2.0 | 0.5 | 0.6 | 0.83 | 25 |
| Comparative Example 2 | 4.0 | 30 | 7.5 | 1.1 | 4.5 | 0.06 | 2.0 | 0.5 | 1.1 | 0.45 | 55 |

TABLE 1-continued

In Table 1, α in [Rw/α] among the items listed in the column for Condition 3 is (dt/dc) × (ρt/ρc), dt represents toner particle diameter (μm), dc represents carrier particle diameter (μm), ρt represents toner density (g/cm$^3$), ρc represents carrier density (g/cm$^3$), Rw represents toner/carrier weight ratio, D represents closest distance (mm), H represents free tip height (mm) and W represents developer supplied amount (mg/cm$^2$).

| | Condition 1 | Condition 2 | | Condition 3 | | | | Condition 4 | | | Condition 5 |
|---|---|---|---|---|---|---|---|---|---|---|---|
| Example | dt | dc | dc/dt | ρt | ρc | Rw | Rw/α(*1) | D | H | D/H | W |
| Comparative Example 3 | 4.0 | 30 | 7.5 | 1.1 | 4.5 | 0.04 | 1.3 | 0.5 | 0.7 | 0.71 | 30 |
| Example 4 | 4.0 | 30 | 7.5 | 1.1 | 4.5 | 0.05 | 1.6 | 0.5 | 0.7 | 0.71 | 30 |
| Example 5 | 4.0 | 30 | 7.5 | 1.1 | 4.5 | 0.08 | 2.3 | 0.5 | 0.7 | 0.71 | 30 |
| Comparative Example 4 | 4.0 | 30 | 7.5 | 1.1 | 4.5 | 0.09 | 2.7 | 0.5 | 0.7 | 0.71 | 30 |
| Example 6 | 3.0 | 15 | 5 | 1.1 | 4.5 | 0.10 | 2.0 | 0.35 | 0.6 | 0.58 | 20 |
| Example 7 | 3.0 | 15 | 5 | 1.1 | 4.5 | 0.10 | 2.0 | 0.35 | 0.5 | 0.70 | 15 |
| Example 8 | 3.0 | 15 | 5 | 1.1 | 4.5 | 0.10 | 2.0 | 0.35 | 0.7 | 0.50 | 25 |
| Comparative Example 5 | 3.0 | 15 | 5 | 1.1 | 4.5 | 0.10 | 2.0 | 0.35 | 0.4 | 0.88 | 10 |
| Comparative Example 6 | 3.0 | 15 | 5 | 1.1 | 4.5 | 0.10 | 2.0 | 0.35 | 0.8 | 0.44 | 30 |
| Example 9 | 3.0 | 15 | 5 | 1.1 | 4.5 | 0.09 | 1.8 | 0.35 | 0.6 | 0.58 | 20 |
| Example 10 | 3.0 | 15 | 5 | 1.1 | 4.5 | 0.11 | 2.3 | 0.35 | 0.6 | 0.58 | 20 |
| Example 11 | 5.0 | 50 | 10 | 1.1 | 4.5 | 0.05 | 2.2 | 0.6 | 0.8 | 0.75 | 25 |
| Example 12 | 5.0 | 50 | 10 | 1.1 | 4.5 | 0.05 | 2.2 | 0.6 | 0.9 | 0.67 | 30 |
| Example 13 | 5.0 | 50 | 10 | 1.1 | 4.5 | 0.05 | 2.2 | 0.6 | 1.0 | 0.60 | 35 |
| Comparative Example 7 | 5.0 | 50 | 10 | 1.1 | 4.5 | 0.05 | 2.2 | 0.6 | 0.7 | 0.86 | 20 |
| Comparative Example 8 | 5.0 | 50 | 10 | 1.1 | 4.5 | 0.05 | 2.2 | 0.6 | 1.3 | 0.46 | 45 |
| Comparative Example 9 | 5.0 | 50 | 10 | 1.1 | 4.5 | 0.05 | 1.3 | 0.6 | 0.9 | 0.67 | 30 |
| Example 14 | 5.0 | 50 | 10 | 1.1 | 4.5 | 0.05 | 2.2 | 0.6 | 0.9 | 0.67 | 30 |
| Example 15 | 5.0 | 50 | 10 | 1.1 | 4.5 | 0.05 | 2.2 | 0.6 | 0.9 | 0.67 | 30 |
| Comparative Example 10 | 5.0 | 50 | 10 | 1.1 | 4.5 | 0.05 | 3.6 | 0.6 | 0.9 | 0.67 | 30 |

*1)α = (dt/dc) × (ρt/ρc)

TABLE 2

Tc represents toner density (weight percent), Vp represents drum velocity (mm/sec), Vs represents sleeve velocity (mm/sec), Rv represents velocity ratio, Asa represents actual supplied amount of toner (mg/cm$^2$), Id represents image density, Lw represents line width, Lq represents letter quality and Bco represents beads carry over.

| | Condition 6 | | | | | Visual Image Aspects | | | | | Visual Image |
|---|---|---|---|---|---|---|---|---|---|---|---|
| Example | Tc | Vp | Vs | Rv | Asa | Id | Fog | Lw | Lq | Bco | Aspect |
| Example 1 | 6 | 180 | 540 | 3.0 | 6.3 | ○ | ○ | ○ | ◎ | ○ | Very excellent |
| Example 2 | 6 | 180 | 540 | 3.0 | 5.4 | ○ | ○ | ○ | ◎ | ○ | Very excellent |
| Example 3 | 6 | 180 | 540 | 3.0 | 9.0 | ○ | ○ | ○ | ○ | ○ | Excellent |
| Comparative Example 1 | 4 | 180 | 270 | 3.0 | 4.5 | ○ | ○ | X | ○ | ○ | Horizontal lines thinned |
| Comparative Example 2 | 6 | 180 | 540 | 3.0 | 9.9 | ○ | ○ | ○ | X | X | Letters scattered, Bco |
| Comparative Example 3 | 4 | 180 | 270 | 1.5 | 1.8 | X | ○ | X | ○ | ○ | Low density, horizontal lines thinned |
| Example 4 | 5 | 180 | 270 | 1.5 | 2.3 | ○ | ○ | ○ | ○ | ○ | Excellent |
| Example 5 | 7 | 180 | 810 | 4.5 | 9.5 | ○ | ○ | ○ | ○ | ○ | Excellent |
| Comparative Example 4 | 8 | 180 | 810 | 4.5 | 10.8 | ○ | X | ○ | ○ | ○ | A bit foggy |
| Example 6 | 9 | 180 | 540 | 3.0 | 5.4 | ○ | ○ | ○ | ◎ | ○ | Very excellent |
| Example 7 | 9 | 180 | 540 | 3.0 | 4.1 | ○ | ○ | ○ | ◎ | ○ | Very excellent |
| Example 8 | 9 | 180 | 540 | 3.0 | 6.8 | ○ | ○ | ○ | ◎ | ○ | Very excellent |
| Comparative Example 5 | 9 | 180 | 540 | 3.0 | 2.7 | ○ | ○ | X | ○ | ○ | Horizontal lines thinned |
| Comparative | 9 | 180 | 540 | 3.0 | 8.1 | ○ | ○ | ○ | X | X | Letters scattered, |

TABLE 2-continued

Tc represents toner density (weight percent), Vp represents drum velocity (mm/sec), Vs represents sleeve velocity (mm/sec), Rv represents velocity ratio, Asa represents actual supplied amount of toner (mg/cm$^2$), Id represents image density, Lw represents line width, Lq represents letter quality and Bco represents beads carry over.

| | Condition 6 | | | | | Visual Image Aspects | | | | | Visual Image |
|---|---|---|---|---|---|---|---|---|---|---|---|
| Example | Tc | Vp | Vs | Rv | Asa | Id | Fog | Lw | Lq | Bco | Aspect |
| Example 6 | | | | | | | | | | | Bco |
| Example 9 | 8 | 180 | 540 | 3.0 | 4.8 | ○ | ○ | ○ | ◎ | ○ | Very excellent |
| Example 10 | 10 | 180 | 540 | 3.0 | 6.0 | ○ | ○ | ○ | ◎ | ○ | Very excellent |
| Example 11 | 5 | 180 | 540 | 3.0 | 3.8 | ○ | ○ | ○ | ○ | ○ | Excellent |
| Example 12 | 5 | 180 | 540 | 3.0 | 4.5 | ○ | ○ | ○ | ◎ | ○ | Very excellent |
| Example 13 | 5 | 180 | 540 | 3.0 | 5.3 | ○ | ○ | ○ | ◎ | ○ | Very excellent |
| Comparative Example 7 | 5 | 180 | 540 | 3.0 | 3.0 | ○ | ○ | X | ○ | ○ | Horizontal lines thinned |
| Comparative Example 8 | 5 | 180 | 540 | 3.0 | 6.8 | ○ | ○ | ○ | X | X | Letters scattered, Bco |
| Comparative Example 9 | 3 | 180 | 270 | 1.5 | 1.4 | X | ○ | X | ○ | ○ | Low density, horizontal lines thinned |
| Example 14 | 5 | 180 | 270 | 1.5 | 2.3 | ○ | ○ | ○ | ○ | ○ | Excellent |
| Example 15 | 5 | 180 | 810 | 4.5 | 6.8 | ○ | ○ | ○ | ◎ | ○ | Very excellent |
| Comparative Example 10 | 8 | 180 | 810 | 4.5 | 10.8 | ○ | X | ○ | X | ○ | Fog, Letters scattered |

In the image forming apparatus of the structure shown in FIG. 2, the position of the developer layer regulating member 44 was changed to the lower section (bottom side) of the housing 49, the rotation direction of the rotary sleeve 40 was changed to the opposite of that of the photosensitive body drum 21 and the magnitude of the displacement angle θ provided inside the rotary sleeve 40 was 5° toward the upstream side in the rotation direction of the photosensitive body drum 21 (the downstream side in the rotation direction of the rotary sleeve 40). Using the image forming apparatus of this structure, similar tests were conducted varying the conditions of each component of the image forming apparatus according to the conditions listed in Table 3 and Table 4 and the results were evaluated

TABLE 3

In Table 3, dt represents toner particle diameter (μm), dc represents carrier particle diameter (μm), ρt represents toner density (g/cm$^3$), ρc represents carrier density (g/cm$^3$), Rw represents weight ratio of toner/carrier, D represents the closest distance (mm), H represents free tip height (mm) and W represents delivered amount of the two-component developer (mg/cm$^2$).

| | Condition 1 | Condition 2 | | Condition 3 | | | | Condition 4 | | | Condition 5 |
|---|---|---|---|---|---|---|---|---|---|---|---|
| Example | dt | dc | dc/dt | ρt | ρc | Rw | Rw/α | D | H | D/H | W |
| Example 16 | 4.0 | 30 | 7.5 | 1.1 | 4.5 | 0.06 | 2.0 | 2.0 | 0.4 | 0.50 | 20 |
| Example 17 | 4.0 | 30 | 7.5 | 1.1 | 4.5 | 0.06 | 2.0 | 0.25 | 0.4 | 0.63 | 20 |
| Example 18 | 4.0 | 30 | 7.5 | 1.1 | 4.5 | 0.06 | 2.0 | 0.3 | 0.4 | 0.75 | 20 |
| Comparative Example 11 | 4.0 | 30 | 7.5 | 1.1 | 4.5 | 0.06 | 2.0 | 0.35 | 0.4 | 0.88 | 20 |
| Comparative Example 12 | 4.0 | 30 | 7.5 | 1.1 | 4.5 | 0.06 | 2.0 | 0.15 | 0.4 | 0.38 | 20 |
| Comparative Example 13 | 4.0 | 30 | 7.5 | 1.1 | 4.5 | 0.04 | 1.3 | 0.3 | 0.4 | 0.75 | 20 |
| Example 19 | 4.0 | 30 | 7.5 | 1.1 | 4.5 | 0.05 | 1.6 | 0.3 | 0.4 | 0.75 | 20 |
| Example 20 | 4.0 | 30 | 7.5 | 1.1 | 4.5 | 0.08 | 2.3 | 0.3 | 0.4 | 0.75 | 20 |
| Comparative Example 14 | 4.0 | 30 | 7.5 | 1.1 | 4.5 | 0.09 | 2.7 | 0.3 | 0.4 | 0.75 | 20 |
| Comparative Example 15 | 4.0 | 30 | 7.5 | 1.1 | 4.5 | 0.05 | 1.6 | 0.3 | 0.4 | 0.75 | 20 |
| Example 21 | 4.0 | 30 | 7.5 | 1.1 | 4.5 | 0.05 | 1.6 | 0.3 | 0.4 | 0.75 | 20 |
| Example 22 | 4.0 | 30 | 7.5 | 1.1 | 4.5 | 0.05 | 1.6 | 0.3 | 0.4 | 0.75 | 20 |
| Example 23 | 4.0 | 30 | 7.5 | 1.1 | 4.5 | 0.08 | 2.3 | 0.3 | 0.4 | 0.75 | 20 |
| Example 24 | 4.0 | 30 | 7.5 | 1.1 | 4.5 | 0.08 | 2.3 | 0.3 | 0.4 | 0.75 | 20 |
| Example 25 | 4.0 | 30 | 7.5 | 1.1 | 4.5 | 0.08 | 2.3 | 0.4 | 0.7 | 0.57 | 30 |
| Example 26 | 4.0 | 30 | 7.5 | 1.1 | 4.5 | 0.08 | 2.3 | 0.4 | 0.7 | 0.57 | 30 |
| Example 27 | 4.0 | 30 | 7.5 | 1.1 | 4.5 | 0.08 | 2.3 | 0.4 | 0.7 | 0.57 | 30 |
| Example 28 | 4.0 | 30 | 7.5 | 1.1 | 4.5 | 0.08 | 2.3 | 0.4 | 0.8 | 0.50 | 35 |

TABLE 3-continued

In Table 3, dt represents toner particle diameter (μm), dc represents carrier particle diameter (μm), ρt represents toner density (g/cm$^3$), ρc represents carrier density (g/cm$^3$), Rw represents weight ratio of toner/carrier, D represents the closest distance (mm), H represents free tip height (mm) and W represents delivered amount of the two-component developer (mg/cm$^2$).

| | Condition 1 | Condition 2 | | Condition 3 | | | | Condition 4 | | | Condition 5 |
|---|---|---|---|---|---|---|---|---|---|---|---|
| Example | dt | dc | dc/dt | ρt | ρc | Rw | Rw/α | D | H | D/H | W |
| Example 29 | 4.0 | 30 | 7.5 | 1.1 | 4.5 | 0.08 | 2.3 | 0.4 | 0.8 | 0.50 | 35 |
| Comparative Example 16 | 4.0 | 30 | 7.5 | 1.1 | 4.5 | 0.08 | 2.3 | 0.4 | 0.8 | 0.50 | 35 |

TABLE 4

Tc represents toner density (weigh percent) , Vp represents drum velocity (mm/sec), Vs represents sleeve velocity (mm/sec), Rv represents velocity ratio, Asa represents actual supplied amount of toner (mg/cm$^2$), Id represents image density, Lw represents line width, Lq represents letter quality and Bco represents beads carry over.

| | Condition 6 | | | | | Visual Image Aspects | | | | | Visual |
|---|---|---|---|---|---|---|---|---|---|---|---|
| Example | Tc | Vp | Vs | Rv | Asa | Id | Fog | Lw | Lq | Bco | Image Aspect |
| Example 16 | 6 | 180 | 360 | 2.0 | 2.4 | ○ | ○ | ○ | ◎ | ○ | Very excellent |
| Example 17 | 6 | 180 | 360 | 2.0 | 2.4 | ○ | ○ | ○ | ◎ | ○ | Very excellent |
| Example 18 | 6 | 180 | 360 | 2.0 | 2.4 | ○ | ○ | ○ | ◎ | ○ | Very Excellent |
| Comparative Example 11 | 6 | 180 | 360 | 2.0 | 2.4 | ○ | ○ | ○ | X | X | Letters scattered, Bco |
| Comparative Example 12 | 6 | 180 | 360 | 2.0 | 2.4 | ○ | ○ | X | ○ | ○ | Horizontal lines thinned |
| Comparative Example 13 | 4 | 180 | 360 | 2.0 | 1.6 | X | ○ | X | ○ | ○ | Low density, horizontal lines thinned |
| Example 19 | 5 | 180 | 360 | 2.0 | 2.0 | ○ | ○ | ○ | ◎ | ○ | Very Excellent |
| Example 20 | 7 | 180 | 360 | 2.0 | 2.8 | ○ | ○ | ○ | ○ | ○ | Excellent |
| Comparative Example 14 | 8 | 180 | 360 | 2.0 | 3.2 | ○ | X | ○ | X | ○ | Fog, Letters scattered |
| Comparative Example 15 | 5 | 180 | 270 | 1.5 | 1.5 | X | ○ | X | ○ | ○ | Low density, Horizontal lines thinned |
| Example 21 | 5 | 180 | 540 | 3.0 | 3.0 | ○ | ○ | ○ | ◎ | ○ | Very excellent |
| Example 22 | 5 | 180 | 720 | 4.0 | 4.0 | ○ | ○ | ○ | ◎ | ○ | Very excellent |
| Example 23 | 7 | 180 | 270 | 1.5 | 2.1 | ○ | ○ | ○ | ○ | ○ | Excellent |
| Example 24 | 7 | 180 | 360 | 2.0 | 2.8 | ○ | ○ | ○ | ○ | ○ | Excellent |
| Example 25 | 7 | 180 | 540 | 3.0 | 6.3 | ○ | ○ | ○ | ○ | ○ | Excellent |
| Example 26 | 7 | 180 | 720 | 4.0 | 8.4 | ○ | ○ | ○ | ○ | ○ | Excellent |
| Example 27 | 7 | 180 | 810 | 4.5 | 9.5 | ○ | ○ | ○ | ○ | ○ | Excellent |
| Example 28 | 7 | 180 | 360 | 2.0 | 4.9 | ○ | ○ | ○ | ○ | ○ | Excellent |
| Example 29 | 7 | 180 | 540 | 3.0 | 7.4 | ○ | ○ | ○ | ○ | ○ | Excellent |
| Comparative Example 16 | 7 | 180 | 810 | 4.5 | 10.0 | ○ | X | ○ | X | ○ | Fog, Letters scattered |

As being clear from the above Tables 1 to 4, very high-quality visual images were formed according to the invention.

As described above, according to the image forming apparatus according to the invention, developing on the magnetic poles is conducted with the main magnetic pole M formed by providing the magnetic poles in a specific arrangement using the two-component developer comprising the toner with small particle diameters satisfying Condition 1 and the carrier with small particle diameters satisfying Condition 2 contained at a ratio satisfying Condition 3, and a latent image on a photosensitive body drum 21 is developed in the situation of a slight contact in which only the tip end of the magnetic brush B is in contact with the photosensitive body drum 21 since the height of the free tip of the magnetic brush B is in a specific situation satisfying Condition 4. Therefore, a visual image having a high image quality equivalent to or better than that of, for example, offset printing can be easily formed.

Furthermore, according to the image forming apparatus 10 of the invention, since the actual delivered amount of the toner supplied actually to the developing area P is secured by satisfying Condition 1, Condition 4, Condition 5 and Condition 6, the lowering of the image density is reliably prevented even in the development conducted under the above-described conditions and, therefore, a high-quality visual image can be reliably formed.

While illustrative and presently preferred embodiments of the present invention have been described in detail herein, it is to be understood that the inventive concepts may be otherwise variously embodied and employed and that the appended claims are intended to be construed to include such variations except insofar as limited by the prior art.

What is claimed is:

1. An image forming apparatus comprising an image forming body, and a developing device for developing a latent image formed on the image forming body with a two-component developer consisting of a toner and a carrier, the developing device including a rotary sleeve positioned facing the image forming body, for delivering the two-component developer and, a magnet system positioned inside the rotary sleeve, for forming a plurality of magnetic poles to form a magnetic brush made of the two-component developer on the surface of the rotary sleeve, and a developer layer regulating member positioned facing the surface of the rotary sleeve, for regulating the amount of the two-component developer delivered by the rotary sleeve, wherein where dt ($\mu$m) represents volume mean particle diameter of the toner in the two-component developer, $\rho t$ (g/cm$^3$) represents density of the toner, dc ($\mu$m) represents volume mean particle diameter of the carrier, $\rho c$ (g/cm$^3$) represents density of the carrier, and Rw represents weight ratio of the toner and the carrier (the ratio of the weight of the toner to the weight of the carrier), Conditions 1, 2 and 3 are satisfied, Condition 1: the volume mean particle diameter dt of the toner falls within the range of 3~5 $\mu$m, Condition 2: the volume mean particle diameter dc falls within the range of 5 dt~10 dt, and Condition 3: the weight ratio Rw of the toner and the carrier falls within the range of 1.6 $(dt/dc)\times(\rho t/\rho c)$~2.4 $(dt/dc)\times(\rho t/\rho c)$ and wherein among a plurality of the magnetic poles included in the magnet system, a main magnetic pole, forming the strongest magnetic field on the surface of the rotary sleeve, is positioned in proximity to the position where the rotary sleeve and the image forming body come closest to each other, and wherein where H (mm) represents the free tip height of the magnetic brush formed at the position of the main magnetic pole, and D (mm) represents the closest distance between the rotary sleeve and the image forming body, Condition 4 is satisfied, Condition 4: the closest distance D falls within the range of 0.5 H~0.8 H.

2. The image forming apparatus according to claim 1, wherein in the developing device, a bias voltage consisting of a DC voltage superimposed with a AC voltage is applied to the rotary sleeve.

3. The image forming apparatus according to claim 1, wherein the rotary sleeve and the image forming body moves in the same direction in a developing area where the rotary sleeve faces the image forming body, and wherein Condition 3A is satisfied as to the weight ratio Rw of the toner and the carrier in the two-component developer, Condition 3A: the weight ratio Rw of the toner and the carrier falls within the range of 1.8 $(dt/dc)\times(\rho t/\rho c)$~2.2 $(dt/dc)\times(\rho t/\rho c)$.

4. The image forming apparatus according to claim 1, wherein the rotary sleeve and the image forming body move in an opposite direction to each other in a developing area where the rotary sleeve faces the image forming body, and wherein, Condition 3B: the weight ratio Rw of the toner and the carrier falls within the range of 1.6 $(dt/dc)\times(\rho t/\rho c)$~2.0 $(dt/dc)\times(\rho t/\rho c)$, is satisfied as to the weight ratio Rw of the toner and the carrier in the two-component developer.

5. The image forming apparatus according to claim 1, wherein in the developing device, the main magnetic pole is arranged on the upstream side in the direction of movement of the image forming body from the closest position of the rotary sleeve and the image forming body.

6. The image forming apparatus according to claim 1, wherein the image forming apparatus comprises a plurality of image forming bodies for forming toner images of colors of yellow, magenta, cyan and black, respectively, and an intermediate transferring body on which each of the toner images formed on the plurality of image forming bodies is transferred and overlaid one after another to form a color image.

7. An image forming apparatus comprising an image forming body, and a developing device for developing a latent image formed on the image forming body with a two-component developer consisting of a toner and a carrier, the developing device including a rotary sleeve positioned facing the image forming body, for delivering the two-component developer and, a magnet system positioned inside the rotary sleeve, for forming a plurality of magnetic poles to form a magnetic brush made of the two-component developer on the surface of the rotary sleeve, and a developer layer regulating member positioned facing the surface of the rotary sleeve, for regulating the amount of the two-component developer delivered by the rotary sleeve, wherein where dt ($\mu$m) represents the volume mean particle diameter of the toner in the two-component developer, W (mg/cm$^2$) represents delivered amount per unit area of two-component developer delivered by the rotary sleeve, Tc (weight percent) represents toner concentration in the two-component developer, and Rv represents a ratio of the moving velocity of the rotary sleeve to the moving velocity of the image forming body, Conditions 1, 5 and 6 are satisfied, Condition 1: the volume mean particle diameter dt of the toner falls within the range of 3~5 $\mu$m, Condition 5: the delivered amount W of the two-component developer falls within the range of 10~50 mg/cm$^2$, and Condition 6: the actual supplied amount of the toner represented by an expression, $(W\times Tc\times Rv)/100$ falls within the range of 2~10 mg/cm$^2$, and wherein among a plurality of magnetic poles included in the magnet system, a main magnetic pole forming the strongest magnetic field on the surface of the rotary sleeve is positioned in proximity to the position where the rotary sleeve and the image forming body come closest to each other, and wherein where H (mm) represents the free tip height of the magnetic brush formed at the position of the main magnetic pole, and D (mm) represents the closest distance between the rotary sleeve and the image forming body, Condition 4 is satisfied, Condition 4: the closest distance D is within the range of 0.5 H~0.8 H is satisfied.

8. The image forming apparatus according to claim 7, wherein where dt ($\mu$m) represents volume mean particle diameter of the toner in the two-component developer, ρt (g/cm$^3$) represents density of the toner, dc ($\mu$m) represents volume mean particle diameter of the carrier, ρc (g/cm$^3$) represents density of the carrier and, Rw represents weight ratio of the toner and the carrier (the ratio of the weight of the toner to the weight of the carrier), Conditions 2 and 3 are satisfied, Condition 2: the volume mean particle diameter dc falls within the range of 5 dt~10 dt, and Condition 3: the weight ratio of the toner and the carrier Rw is within the range of 1.6 (dt/dc)×(ρt/ρc)~2.4 (dt/dc)×(ρt/ρc).

9. The image forming apparatus according to claim 8, wherein in the developing device, a bias voltage consisting of a DC voltage superimposed with a AC voltage is applied to the rotary sleeve.

10. The image forming apparatus according to claim 7 wherein the rotary sleeve and the image forming body move in the same direction in a developing area where the rotary sleeve faces the image forming body, and wherein Condition 6A is satisfied, Condition 6A: the actual supplied amount of the toner represented by an expression, (W×Tc×Rv)/100 falls within the range of 4~8 mg/cm$^2$.

11. The image forming apparatus according to claim 7, wherein the rotary sleeve and the image forming body move in an opposite direction to each other in a developing area where the rotary sleeve faces the image forming body, and wherein Condition 6B is satisfied, Condition 6B: The actual supplied amount of the toner represented by an expression, (W×Tc×Rv)/100 falls within the range of 2~6 mg/cm$^2$.

12. The image forming apparatus according to claim 7, wherein in the developing device, the main magnetic pole is arranged on the upstream side in the moving direction of the image forming body from the closest position of the rotary sleeve and the image forming body.

13. The image forming apparatus according to claim 7, wherein the image forming apparatus comprises a plurality of image forming bodies for forming toner images of colors of yellow, magenta, cyan and black, respectively, and an intermediate transferring body on which each of the toner images formed on the plurality of image forming bodies is transferred and overlaid one after another to form a color image.

* * * * *